US009897387B2

(12) United States Patent
Glass

(10) Patent No.: US 9,897,387 B2
(45) Date of Patent: Feb. 20, 2018

(54) HEAT EXCHANGER WITH DOUBLE-WALLED TUBES

(71) Applicants: BENTELER AUTOMOBILTECHNIK GMBH, Paderborn (DE); BENTELER AUTOMOTIVE CORPORATION, Auburn Hills, MI (US)

(72) Inventor: Michael T. Glass, Shelbyville, MI (US)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 326 days.

(21) Appl. No.: 14/398,371

(22) PCT Filed: Apr. 30, 2013

(86) PCT No.: PCT/EP2013/001282
§ 371 (c)(1),
(2) Date: Oct. 31, 2014

(87) PCT Pub. No.: WO2013/164085
PCT Pub. Date: Nov. 7, 2013

(65) Prior Publication Data

US 2015/0107806 A1 Apr. 23, 2015

Related U.S. Application Data

(60) Provisional application No. 61/641,099, filed on May 1, 2012.

(30) Foreign Application Priority Data

Jan. 29, 2013 (DE) ..... 10 2013 100 886

(51) Int. Cl.
*F28F 1/00* (2006.01)
*F28D 7/10* (2006.01)
*F28D 7/00* (2006.01)

(52) U.S. Cl.
CPC ..... *F28D 7/103* (2013.01); *F28D 7/0066* (2013.01); *F28F 1/003* (2013.01)

(58) Field of Classification Search
CPC ..... F28D 7/103; F28D 7/0066; F28F 1/003
(Continued)

(56) References Cited

U.S. PATENT DOCUMENTS 661,110 A * 11/1900 Schwerdfeger et al. ..... F28D 7/103 165/155
1,447,518 A * 3/1923 Safberg ..... C01C 1/047 165/143
(Continued)

FOREIGN PATENT DOCUMENTS

AU 489 755 1/1978
CA 2745590 * 12/2012
(Continued)

OTHER PUBLICATIONS

International Search Report issued by the European Patent Office in International Application PCT/EP2013/001282.

*Primary Examiner* — Ljiljana Ciric
(74) *Attorney, Agent, or Firm* — Henry M. Feiereisen LLC

(57) ABSTRACT

A heat exchanger for a motor vehicle, in particular an exhaust gas heat exchanger, includes an outer casing in which heat exchanger tubes are arranged as bundles. At least one heat exchanger tube is configured double-walled, and formed from an outer tube and an inner tube. A first medium
(Continued)

flows in the casing and/or in the inner tube and a second medium flows between the outer tube and the inner tube.

15 Claims, 5 Drawing Sheets

(58) Field of Classification Search
USPC ..... 165/155
See application file for complete search history.

(56) References Cited

U.S. PATENT DOCUMENTS 1,787,904 A * 1/1931 Heyward ..... B60H 1/00335 126/19.5
1,852,490 A * 4/1932 Sullivan ..... F28D 7/024 165/109.1
1,961,907 A * 6/1934 Mott ..... F28D 7/12 165/140
1,977,809 A * 10/1934 Sutter ..... B60H 1/18 165/154
2,197,243 A * 4/1940 Moran ..... F28B 1/02 138/38
2,259,433 A * 10/1941 Kitto ..... B21D 53/06 138/113
2,441,344 A * 5/1948 Bosworth ..... F16L 19/028 285/321
2,545,280 A * 3/1951 Buchert ..... C12C 7/26 138/114
2,549,687 A * 4/1951 Jack ..... F28D 7/022 165/156
2,703,921 A * 3/1955 Brown, Jr. ..... B21C 37/225 165/141
2,993,682 A * 7/1961 Huet ..... F22B 1/162 138/38
3,386,497 A * 6/1968 Feldmeier ..... F28D 7/026 165/11.1
3,438,430 A * 4/1969 Kestemont ..... F22B 1/066 138/113
3,568,764 A * 3/1971 Newman ..... F28D 7/06 165/134.1
3,706,343 A * 12/1972 Saiga ..... C21B 7/10 122/6 R
3,722,583 A * 3/1973 Fiedler ..... B01D 53/26 165/156
3,889,746 A * 6/1975 Laffranchi ..... F28D 7/103 165/155
3,948,315 A * 4/1976 Powell ..... F28D 7/06 165/143
4,194,560 A * 3/1980 Matsuzaki ..... F01P 11/08 165/141
4,210,199 A * 7/1980 Doucette ..... F28D 7/106 165/143
4,215,743 A * 8/1980 Margittai ..... F28D 7/026 165/141
4,237,968 A * 12/1980 Duke ..... F22B 1/066 165/70
4,242,877 A * 1/1981 Geerkens ..... B01D 53/26 165/141
4,254,826 A * 3/1981 Adams ..... F28D 7/106 165/143
4,326,582 A * 4/1982 Rosman ..... F28D 7/026 165/143
4,343,350 A * 8/1982 Campbell ..... F24H 1/208 165/11.1
4,372,374 A * 2/1983 Lee ..... F28D 7/103 165/154
4,437,217 A * 3/1984 Lallaye ..... F28F 21/04 165/133
4,440,217 A * 4/1984 Stieler ..... F28D 7/106 165/143
4,451,966 A * 6/1984 Lee ..... F28D 7/103 138/114
4,455,733 A * 6/1984 Smith ..... B23K 20/08 266/193
4,462,463 A * 7/1984 Gorham, Jr. ..... F28D 7/0066 165/140
4,585,059 A * 4/1986 Lee ..... F28D 7/106 138/113
4,635,711 A * 1/1987 Clark, Jr. ..... F28D 7/06 165/158
4,638,852 A * 1/1987 Basseen ..... B01D 53/265 165/113
4,666,186 A * 5/1987 Twomey ..... F28F 1/003 285/14
4,735,259 A * 4/1988 Vincent ..... G01N 30/30 165/135
4,744,412 A * 5/1988 Kim ..... F28F 1/003 138/148
4,747,447 A * 5/1988 Scanlan ..... F24H 1/121 165/104.14
4,834,172 A 5/1989 Duran
4,858,681 A * 8/1989 Sulzberger ..... F17D 5/04 165/158
4,871,014 A * 10/1989 Sulzberger ..... F17D 5/04 165/158
4,883,117 A * 11/1989 Dobbs ..... F28D 7/0033 165/156
4,893,670 A * 1/1990 Joshi ..... F01P 11/08 123/196 AB
4,972,902 A * 11/1990 Ninomiya ..... F22B 1/066 165/11.1
4,991,643 A * 2/1991 Price ..... F28F 27/02 165/101
5,033,541 A * 7/1991 D'Silva ..... B01D 5/0009 165/114
5,107,919 A * 4/1992 Basseen ..... B01D 53/265 165/113
5,181,560 A * 1/1993 Burn ..... F28F 1/42 122/510
5,375,654 A * 12/1994 Hougland ..... F28F 13/12 138/38
5,551,504 A * 9/1996 Zifferer ..... B21C 37/151 165/155
5,725,051 A * 3/1998 Veltkamp ..... F28F 21/06 165/164
5,950,716 A * 9/1999 Appelquist ..... F28D 7/106 165/109.1
6,115,919 A * 9/2000 Oswald ..... F28D 9/04 29/890.034
6,220,344 B1 * 4/2001 Beykirch ..... F28D 7/022 165/154
6,321,743 B1 * 11/2001 Khinkis ..... F23C 3/002 126/91 A
6,390,185 B1 5/2002 Proeschel
6,688,378 B2 * 2/2004 O'Donnell ..... F24H 9/0026 138/40
6,712,885 B1 * 3/2004 Basseen ..... B01D 53/002 55/282.5
6,920,917 B2 * 7/2005 Inoue ..... F28F 1/06 165/154
7,077,165 B2 * 7/2006 Takasaki ..... F16L 9/18 138/108
7,266,953 B2 * 9/2007 Schuetz ..... B01D 5/0015 261/153
7,506,680 B1 * 3/2009 Castillo ..... F28D 7/024 123/41.49
7,866,378 B2 * 1/2011 Nakamura ..... F16L 7/00 138/114
7,984,752 B2 * 7/2011 Yusa ..... F28D 7/106 165/141
8,590,604 B2 * 11/2013 Higashiyama ..... B21D 53/06 165/141

(56) References Cited

U.S. PATENT DOCUMENTS

| | | | | |
|---|---|---|---|---|
| 9,091,487 | B2 * | 7/2015 | Byon | F28D 7/106 |
| 2010/0260651 | A1 * | 10/2010 | Lehr | B01J 8/025 422/201 |

FOREIGN PATENT DOCUMENTS

| | | | |
|---|---|---|---|
| DE | 36 12 770 | | 10/1987 |
| DE | 37 25 881 | | 2/1989 |
| DE | 43 43 405 | | 6/1995 |
| DE | 10021771 | * | 11/2000 |
| EP | 0013796 | A1 * | 8/1980 |
| JP | S59-87580 | | 6/1984 |
| JP | H10339598 | | 12/1998 |
| JP | 2008-134003 | | 6/2008 |
| JP | 2011136364 | | 7/2011 |
| WO | WO 2011/111778 | | 9/2011 |
| WO | WO 2012/008348 | | 1/2012 |

* cited by examiner b)

a)

HEAT EXCHANGER WITH DOUBLE-WALLED TUBES

CROSS-REFERENCES TO RELATED APPLICATIONS

This application is the U.S. National Stage of International Application No. PCT/EP2013/001282, filed Apr. 30, 2013, which designated the United States and has been published as International Publication No. WO 2013/164085 and which claims the priority of U.S. Provisional Application, Ser. No. 61/641,099, filed May 1, 2012 and of German Patent Application, Serial No. 10 2013 100 886.0, filed Jan. 29, 2013, pursuant to 35 U.S.C. 119(a)-(d).

BACKGROUND OF THE INVENTION

The present invention relates to a heat exchanger for a motor vehicle in particular an exhaust gas heat exchanger.

It is known from the state-of-the-art to in particular use heat exchangers in motor vehicles in order to cool components by means of a medium and/or withdraw heat from a medium in a targeted manner. It is thus for example possible to cool the cooling water of an internal combustion engine of a motor vehicle in a targeted manner by a second medium, in particular air. However, it is also possible to cool the exhaust gas of a motor vehicle in order to for example supply the cooled exhaust gas again to the combustion process.

From DE 434 34 05 A1 a tube bundle heat exchanger is for example known in which a medium is introduced on one end, impacts a tube bottom and accumulates at the tube bottom and is then conducted through heat exchanger tubes situated in the tube bottom. In accordance with the cross flow principle, a second medium is then introduced on the outside of a sheath of the heat exchanger, which flows through the heat exchanger and exits the heat exchanger at an exit site opposite the entry site of the second medium.

A disadvantage hereby is that, in particular when using such a tube bundle heat exchanger as exhaust gas heat exchanger, the tube bottom is exposed at least locally to the high temperatures of the flowing exhaust gas.

SUMMARY OF THE INVENTION

An object of the present invention is therefore to increase the heat exchanging efficiency of a heat exchanger at same or reduced outer dimensions of the heat exchanger.

The above-mentioned object is solved according to the invention with a heat exchanger for a motor vehicle, in particular an exhaust gas heat exchanger, including an outer sheath; and heat exchanger tubes arranged in the outer sheath, the heat exchanger tubes each including an outer tube and an inner tube received in the outer tube, said outer tube and inner tubes being separately produced components, wherein an opening is provided in a region of an end of the outer tube for flow of a first medium into or out of the inner tube, wherein the first medium flows in the outer sheath and in the inner tube and a second medium flows between the outer tube and the inner tube, and wherein the outer tube and the inner tube are form fittingly and/or materially bodingly coupled with each other via a collar provided on the opening.

Advantageous embodiments of the present invention are the subject matter of the dependent patent claims.

The heat exchanger according to the invention for a motor vehicle, in particular exhaust gas heat exchanger, which has an outer sheath and heat exchanger tubes in particular arranged as bundle arranged in the outer sheath, is characterized in that at least one heat exchanger tube is formed double-walled from an outer tube and an inner tube, wherein a first medium flows in the sheath and/or in the inner tube and a second medium flows between the outer tube and the inner tube.

Within the scope of the invention, the heat exchanger is in particular used as exhaust gas heat exchanger in order to cool exhaust gas of an internal combustion engine in the motor vehicle. However, it is also possible within the scope of the invention to use the heat exchanger for example for cooling of fluids, as oil cooler or as cooling water cooler.

The heat exchanger itself is in particular configured as tube bundle heat exchanger. Within the framework of the invention this means that multiple heat exchanger tubes are combined into a tube bundle and are arranged in an outer sheath. The sheath is known from the state-of-the-art also as casing or housing. Thus a first channel through which a first medium can flow is formed in the heat exchanger tubes and a second channel is formed between the sheath and the outside of the heat exchanger tubes. Thus a first medium flows through the heat exchanger tubes and a second medium flows around an outside of the heat exchanger tubes so that a heat transfer between the two media is established.

Within the framework of the invention the heat exchanger is in particular configured as a heat exchanger that operates according to the parallel flow principle. According to the invention it is provided to configure the heat exchanger tubes not as single-layered or single-walled tubes, but as double-layered heat exchanger tubes. Thus initially a third channel is provided, wherein according to the invention a first medium flows in the sheath, i.e., in the space between the inner surface of the sheath and the outer surface of the outer tube. The double-layered heat exchanger tubes result in a second channel formed between the outer tube and the inner tube through which according to the invention a second medium flows. Thus, a heat exchange takes place between the first medium and second medium via the outer surface of the outer tube.

According to the invention it is further provided that a further channel is formed in the inner tube, wherein the first medium can also optionally or simultaneously be conducted through the inner tube. Thus a further heat transition from the first medium to the second medium takes place via the sheath surface of the inner tube. As a result of this measure according to the invention the efficiency of the heat exchanger is increased while at the same time maintaining the same or even reduced outer dimensions of the entire heat exchanger. The counter pressure of the flowing media generated by the heat exchanger has only a negligible adverse effect if any.

In order for the first medium to flow into the inner tube, an opening is provided in the region of the end of the outer tube, in particular in the outer surface of the other tube, so as to allow the first medium to flow into the inner tube, flow through the inner tube and flow out of the inner tube again. Preferably such an opening is also provided on the exit side, in particular in the outer surface of the outer tube.

The opening is in particular configured as a collar, wherein the collar is inwardly directed in radial direction of the outer tube and is thus oriented towards the inner tube. The collar can further preferably be coupled with the inner tube itself, so that the collar already effects a positional fixation of the inner tube, while at the same time also creating a passage for the first medium, wherein the first medium can then be transferred through the passage into the interior of the inner tube.

Within the scope of the invention, the inner tube and the outer tube are preferably components that are produced separate from each other, and which then owing to the construction according to the invention can be inserted into each other and are form fittingly fixable in position and can be coupled in a materially bonding, in particular fluid tight manner via the opening, particularly preferably via the collars in the region of the opening.

A corresponding opening with collar can then also be formed on the inner tube, wherein the collar of the inner tube is outwardly oriented in radial direction. The collar of the inner tube and the collar of the outer tube are then oriented relative to each other so as to extend toward each other and form a through passage in order to transport a medium into the interior of the inner tube or out of the inner tube.

In order for the third channel to be closed in itself inside the inner tube and to prevent flow of the second medium against the third channel, it is further provided that the ends of the inner tube are closed. This can for example be achieved by compressing the ends. According to the invention it is provided however that sealing plugs or sealing caps are arranged. Within the scope of the invention, the caps are inserted in particular form fittingly into the inner tube or are pushed onto the inner tube and are optionally form fittingly coupled, in particular in a fluid tight manner, with the inner tube.

Further preferably, the ends of the heat exchanger are configured so that a gap is formed between the outer tube and the inner tube, wherein the gap is in particular configured to have a circumferential even extent. The second medium introduced into the heat exchanger can thus flow through the gap formed between the inner tube and the outer tube into the second channel of the heat exchanger tube and flow through the heat exchanger tube. The second channel is thus formed between the outer surface of the inner tube and the inner surface of the outer tube. Preferably, the heat exchanger is configured so that the second medium is introduced on a front side and/or is conducted out of the heat exchanger at a front side. The term front side within the scope of the invention is to be understood in particular in relation to the arrangement of the sheath of the heat exchanger.

In order to ensure a flow-optimized influx into the heat exchanger tubes, the end of the inner tube is in particular configured tapered. Particularly preferably the end is configured so that the tip has a progressively increasing tapered extent. The end is thus flow-optimized, and thus a second medium is optimally introduced into the second channel between the inner surface of the outer tube and the outer surface of the inner tube. In particular the counter pressure of the motor vehicle heat exchanger is thereby not increased or only to an insignificant degree.

In a further advantageous embodiment of the present invention it is provided that at least the outer tube and/or the inner tube have a waved course, in particular the sheath surface of the inner tube and/or of the outer tube is waved in longitudinal direction. This means that the waveform respectively relative to an infinitesimal axial longitudinal section, with regard to the longitudinal center axis of the heat exchanger tube has a radially circumferentially constant radius. In longitudinal direction of the respective tube, i.e., the outer tube and/or the inner tube, a waveform thus results on the respective outer surface and/or inner surface.

The waveform results on one hand in an increase of the tube surface available for the heat transfer. On the other hand the waveform creates a turbulence in the flow which also improves the heat transfer between flowing media and the wave tube. In addition, the waveform enables an improved thermal expansion of the respective tube in longitudinal direction.

In order to in particular also make it possible to produce heat exchanger tubes more cost effectively and/or so as to have flow optimized properties, it is further provided that the inner diameter of a wave trough of the outer tube is greater than the other diameter of a wave pinnacle of the inner tube. This makes it possible to produce the two tubes, i.e., the outer tube and/or the inner tube, separate from each other and subsequently insert the inner tube in longitudinal direction into the outer tube. The inner tube can then in turn be fixed in position in the outer tube, in particular arranged centered through coupling via the collars.

Within the scope of the invention, the heat exchanger tubes can be formed in particular from a metallic alloy, particularly preferably from a metallic material, particularly preferably from a metal material, which is resistant against corrosive exhaust gas, in particular a stainless steel material. Within the scope of the invention it is also possible however that the heat exchanger tubes are made from a lightweight metal for example aluminum or form a brass material or the like. The tubes can however also be formed from copper, brass or bronze. Further preferably the tubes, i.e., the inner and/or the outer tube, are formed by means of hydroforming.

In order to facilitate the coupling according to the invention of the first channel and the third channel, it is further provided that two spaced-apart front plates are arranged at an influx side and/or an outflow side in the sheath of the heat exchanger, wherein the outer tube respectively traverses the front plates, and is coupled with the front plate in a fluidly tight manner. The coupling occurs so that the openings are situated in the outer surface of the outer tube between the front plates, i.e., at the distance of the front plates, wherein the front plate which points toward the sheath has additional recesses between the outer tubes, i.e., the heat exchanger tubes. Thus a first medium can initially be conducted into the spaced-apart inter space between the two front plates and is distributed in this space outside of the outer surface of the outer tubes. Via the openings the first medium enters the inner spaces of the inner tubes and via the recesses in the front plate, which is directed toward the sheath, into the heat exchanger space, i.e., the space between the sheath and the outer surface of the outer tube. Preferably only the outer front plate is coupled in a fluid tight manner with the heat exchanger tubes.

The inner front plate is then coupled to the recess for passage of the heat exchanger tubes so as to abut the recesses but not necessarily in a fluid tight manner.

The second medium is then introduced at the front side, i.e., at the outer front plate, and flows via the gap between the outer tube and the inner tube into the second channel formed between the outer tube and the inner tube. A two-sided heat exchange takes place between the two media, on one hand over the sheath surface of the outer tube and on the other and over the sheath surface of the inner tube.

BRIEF DESCRIPTION OF THE DRAWING

Further advantages, features properties and aspects of the present invention are the subject matter of the following description. Preferred embodiments are shown in the schematic figures. These serve for facilitating understanding of the invention. It is shown in.

In the Figures, the same reference numerals are used for the same or similar components, even when a repeated description is not given for reasons of simplicity.

DETAILED DESCRIPTION OF PREFERRED EMBODIMENTS

Figure 1:
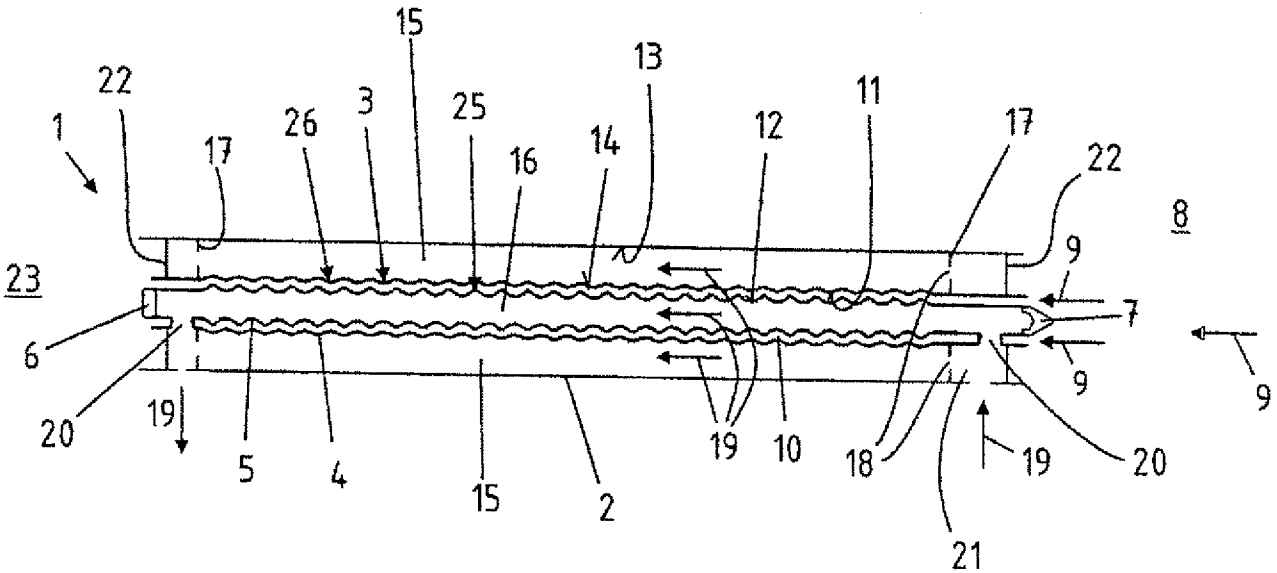
FIG. 1 a principle construction of a heat exchanger according to the invention in a cross sectional view.

FIG. 1 shows a cross section through a heat exchanger 1 according to the invention. The heat exchanger 1 has an outer sheath 2, wherein a heat exchanger tube 3 is arranged in the sheath 2. The present invention is not limited to arrangement of only one heat exchanger tube 3 in the sheath 2, multiple heat exchanger tubes 3 can also be arranged in the sheath 2. The heat exchanger tube 3 itself is divided into an outer tube 4 and an inner tube 5, wherein the inner tube 5 has sealing caps 6, 7 on each of its ends. The sealing cap 7 on an influx side is configured tapered so that an inflowing second medium 9 impacts the tip and subsequently flows into a second channel 10, wherein the second channel 10 is formed between the inner surface 11 of the outer tube 4 and the outer surface 12 of the inner tube 5.

Between the inner surface 13 of the sheath 2 and the outer surface 14 of the outer tube 4 a first channel 15 is formed and a third channel 16 is formed inside the inner tube 5. The first channel 15 and the third channel 16 a fluidly coupled with each other via an inner front plate 17, in particular via recesses 18 in the inner front plate 17. An inflowing first medium 19 thus enters the third channel 16 via an opening 20 form an influx space 21 between the inner front plate 17 and the outer front plate 22. Via the recesses 18 in the inner front plate 17 the first medium 19 then enters the first channel 15 and flows from the influx side 8 to the outflow side 23. The shown heat exchanger 1 operates according to the parallel flow principle. Within the scope of the invention it is however also conceivable to construct the heat exchanger 1 according to the counter flow principle.

Within the scope of the invention multiple openings 20 can also be formed so that corresponding medium can flow not only via one opening on each side into the third channel 16 but also via multiple openings on each side.

Figure 2:
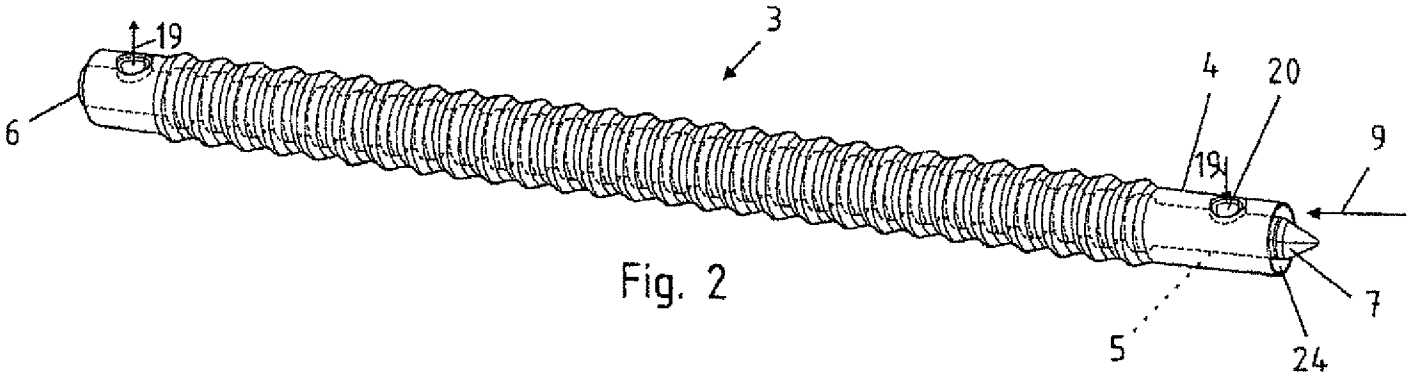
FIG. 2 a heat exchanger according to the invention in a perspective view.

FIG. 2 shows the heat exchanger tube 3 according to the invention in a perspective view, wherein the outer tube 4 is here shown with an internally inserted inner tube 5. A fluid flows via an opening 20 of the outer tube 4 into the inner space of the inner tube 5. The inner tube 5 is in turn closed against an influx on the front side via the sealing caps 7. Between the inner tube 5 and the outer tube 4 an even gap 24 is formed on the influx side so that a second medium 9 can flow between the inner tube 5 and the outer tube 4.

Figure 3:
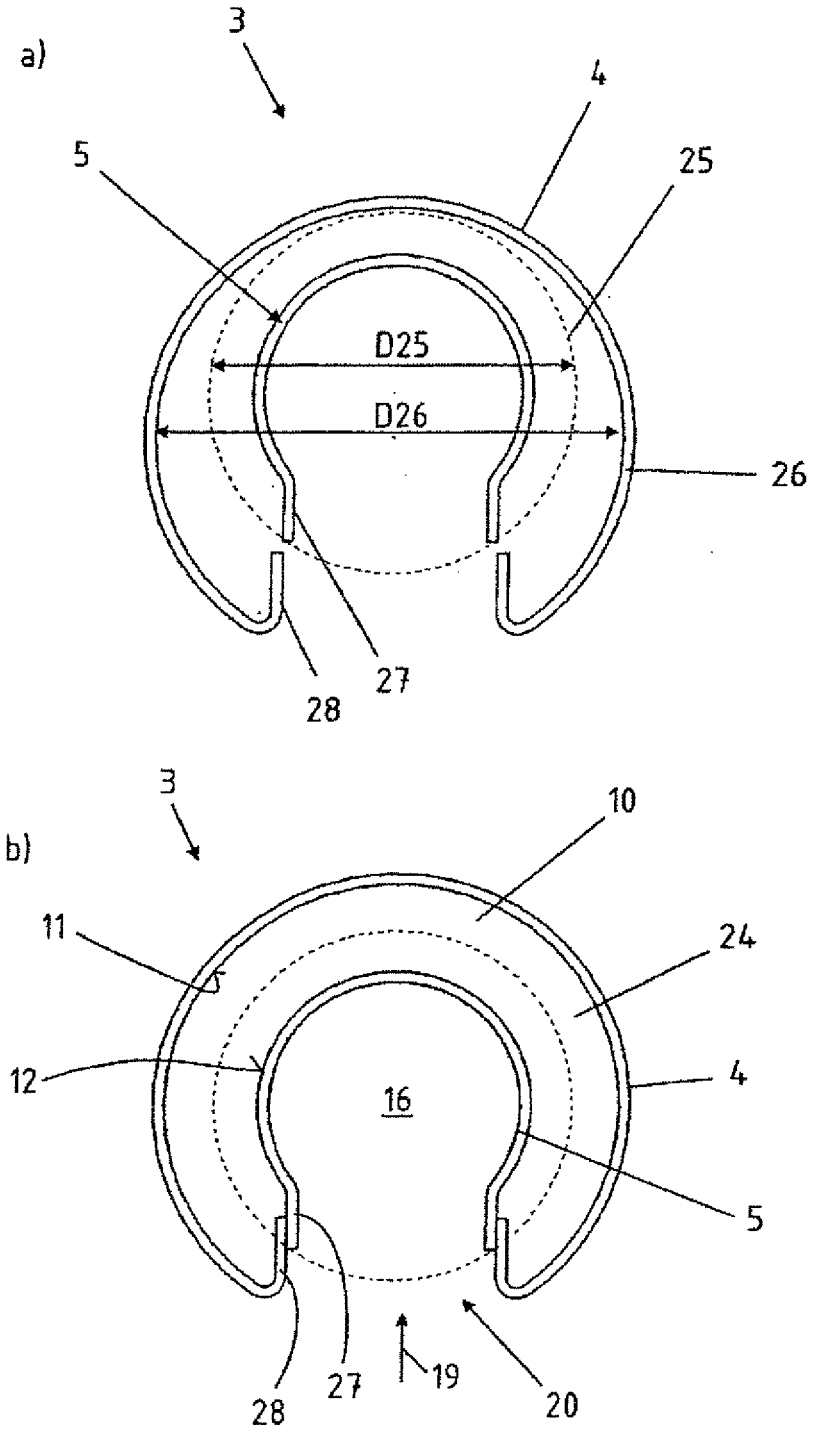
FIGS. 3*a* and *b* a heat exchanger according to the invention in a front view and FIGS. 4*a* to 4*c* a heat exchanger according to the invention in a perspective view with and without sheath.

FIGS. 3*a*) and *b*) illustrate this idea once more, wherein the circumferential even gap 24 is here well shown in FIG. 3*b*. In order to make it possible that the two tubes, i.e., outer tube 4 and inner tube 5 can be manufactured separate, the outer diameter D25 of a wave crest 25 of the inner tube 5 is smaller than the inner diameter D26 of a wave trough 26 of the outer tube 4. Not shown in the front view of FIGS. 3*a* and *b* are the wave crests 25 following the wave trough 26 of the outer tube 4. These however are shown in FIG. 1. This makes it possible to initially produce the inner tube 5 separate from the outer tube 4 and to subsequently insert it into the outer tube 4 in longitudinal direction.

The inner tube 5 further has a collar 27 which protrudes radially outwardly and which according to FIG. 3*b* is form fittingly coupled with a radially inwardly protruding collar 28 of the outer tube 4. In particular the collar 27 can also be coupled in a materially bonding and particularly preferably in a fluid tight manner. The two collars 27, 28 then result in an opening 20 for influx of the first medium 19 into the third channel 16. The second channel 10 is formed between an outer surface 12 of the inner tube 45 and the inner surface 11 of the outer tube 4.

Figure 4:
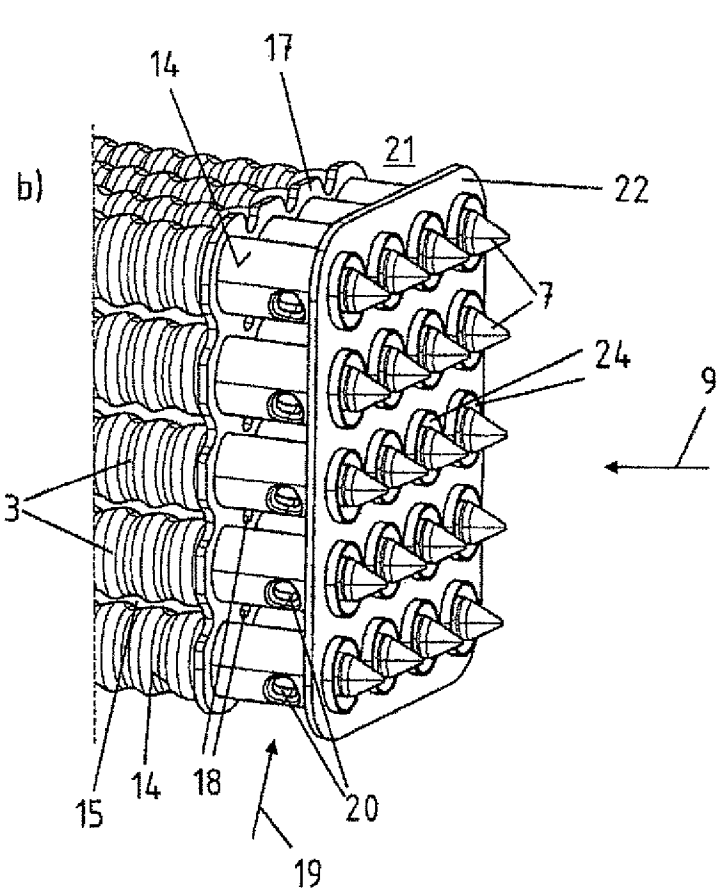
Figure 4:
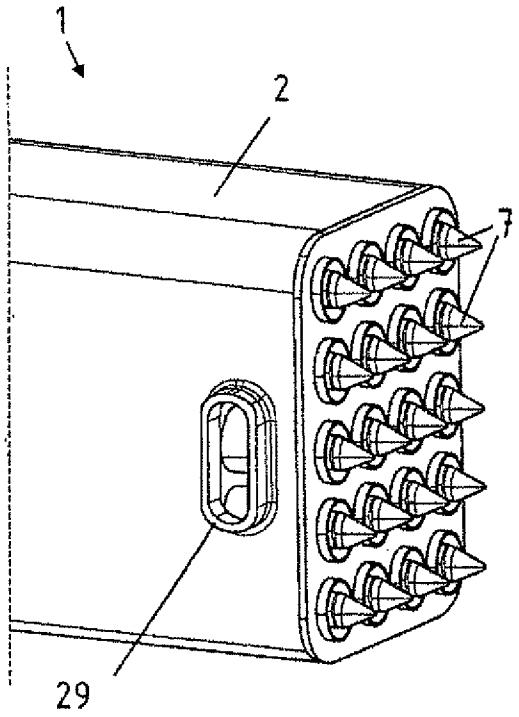
Figure 4:
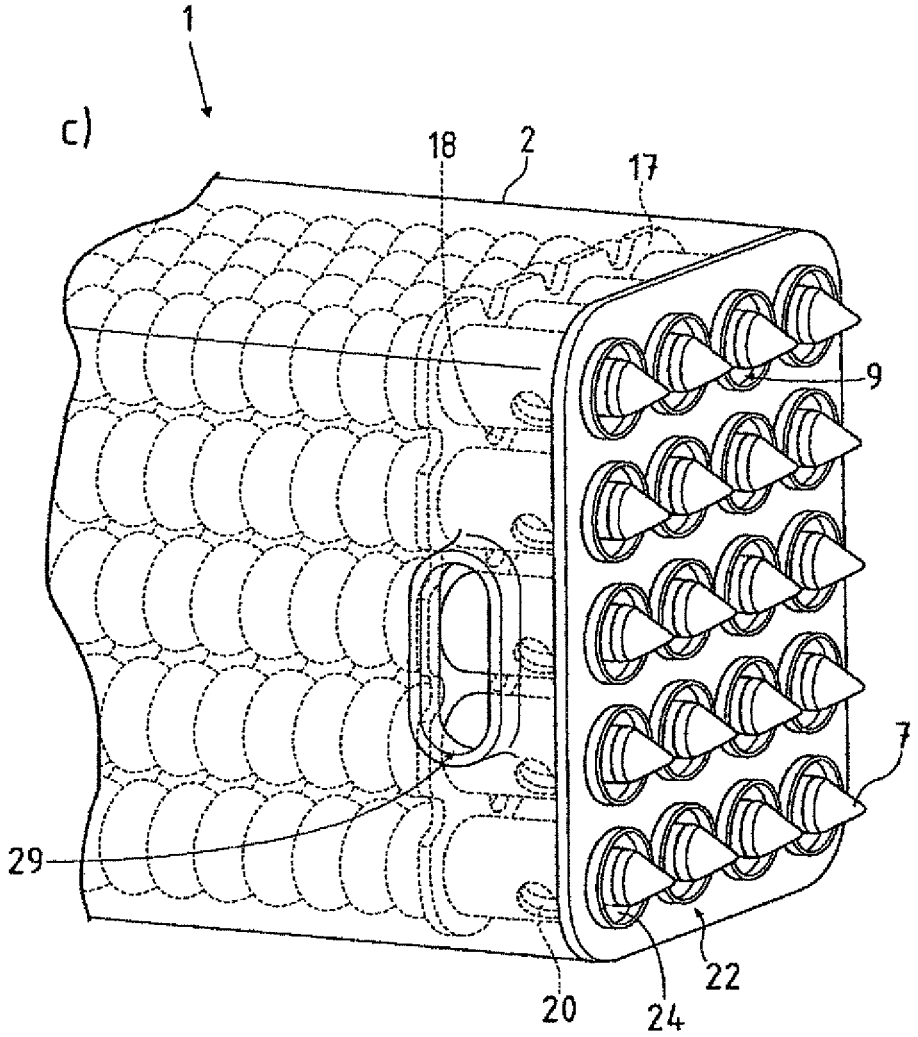

In order to enable flow of the first medium 19 into the first channel 15 and also into the third channel 16, and flow of the second medium 9 into the second channel 10, the invention provides according to FIGS. 4*a* and *b* that an inflow opening 29 or in opposite direction an outflow opening for the first medium 19 is provided in the sheath 2 of the heat exchanger 1. Through this opening the first medium 19 enters into the inflow space 21 between the inner front plate 17 and the outer front plate 22. Here, it impacts the outer surface 14 of the outer tube 4 and enters via openings 20 into the inner tube 5. Further, recesses 18 are also formed in the inner front plate 17, via which recesses the first medium 19 situated in the inflow space 21 then also flows into the first channel 15 between the sheath 2 and the outer surface 14 of the outer tube 4. The second medium 9 flows against the outer front plate 22 and via the gap 24 between outer tube 4 and inner tube 5 into the second channel 10 between the inner tube 5 and the outer tube 4.

FIG. 4*c* further shows a perspective partial view according to FIG. 4*a* with the interior shown in FIG. 4*b*.

What is claimed is:

1. A heat exchanger for a motor vehicle, comprising:

an outer sheath;

heat exchanger tubes arranged in the outer sheath, said heat exchanger tubes each comprising an outer tube, said outer tube including an inner tube received in the outer tube, in one-to-one correspondence, said outer tube and inner tube being separately produced components, wherein an opening is provided in a region of an end of the outer tube for flow of a first medium into or out of the inner tube, wherein the first medium flows in the outer sheath and in the inner tube and a second medium flows between the outer tube and the inner tube, and wherein the outer tube and the inner tube are arranged in a form fitting or in a materially bonding manner coupled with each other via a collar provided on the opening; and a sealing cap or a sealing plug is arranged in each of respective ends of the inner tube.

2. The heat exchanger of claim 1, wherein the heat exchanger tubes are arranged as a bundle.

3. The heat exchanger of claim 1, wherein the opening is provided in an outer surface of the outer tube.

4. The heat exchanger of claim 3, further comprising two spaced-apart front plates arranged on an inflow side and/or an outflow side in the outer sheath, wherein the outer tube is coupled with the front plates in a fluid tight manner and traverses the front plates, so that the opening in the outer surface of the outer tube is arranged between the front plates, and wherein one of the front plates faces the outer sheath and has recesses arranged between the heat exchanger tubes.

5. The heat exchanger according to claim 1, wherein the collar is configured so that the inner tube is fixed in position relative to the outer tube by the coupling of the inner tube to the outer tube via the collar.

6. The heat exchanger of claim 1, wherein the sealing cap or a sealing plug is arranged in ends of the inner tube in a materially bonding or form fitting manner.

7. The heat exchanger of claim 1, wherein a gap is formed between respective ends of the outer tube and respective ends of the inner tube.

8. The heat exchanger of claim 7, wherein the gap is a radially circumferential gap.

9. The heat exchanger of claim 1, wherein the end of the inner tube is configured tapered.

10. The heat exchanger of claim 9, wherein the end of the inner tube has a progressively increasing tapering.

11. The heat exchanger of claim 1, wherein at least one of the outer tube or the inner tube has a waved course.

12. The heat exchanger of claim 11, wherein the waved course of the outer tube and/or the inner tube has wave crests and wave troughs, and wherein the wave crests and wave troughs are each configured to have a constant radially circumferential extent relative to a circumferential axis.

13. The heat exchanger of claim 12, wherein an outer diameter of a wave crest of the inner tube is smaller than an inner diameter of a wave trough of the outer tube.

14. The heat exchanger of claim 1, wherein the surface of the inner tube or the outer tube is waved in a longitudinal direction relative to a longitudinal axis.

15. The heat exchanger of claim 1, wherein the inner tube and/or the outer tube are produced by hydroforming.

* * * * *